US006661875B2

(12) United States Patent
Greenwald et al.

(10) Patent No.: US 6,661,875 B2
(45) Date of Patent: Dec. 9, 2003

(54) CATHETER TIP X-RAY SOURCE

(75) Inventors: Anton C. Greenwald, North Andover, MA (US); Ward D. Halverson, Cambridge, MA (US)

(73) Assignee: Spire Corporation, Bedford, MA (US)

( * ) Notice: Subject to any disclaimer, the term of this patent is extended or adjusted under 35 U.S.C. 154(b) by 0 days.

(21) Appl. No.: 10/142,288

(22) Filed: May 9, 2002

(65) Prior Publication Data

US 2003/0210765 A1 Nov. 13, 2003

(51) Int. Cl.[7] ..... G21G 4/00

(52) U.S. Cl. ..... 378/119; 378/121; 600/433; 600/435

(58) Field of Search ..... 378/119, 121, 378/122, 136, 65, 64; 600/433, 435, 459, 466, 585, 2; 607/100, 119

(56) References Cited

U.S. PATENT DOCUMENTS

| | | | | |
|---|---|---|---|---|
| 5,090,043 | A | | 2/1992 | Parker et al. |
| 5,153,900 | A | | 10/1992 | Nomikos et al. |
| 5,428,658 | A | | 6/1995 | Oettinger et al. |
| 5,566,221 | A | | 10/1996 | Smith et al. |
| 5,651,767 | A | * | 7/1997 | Schulman et al. |
| 5,729,583 | A | | 3/1998 | Tang et al. |
| 5,831,800 | A | | 11/1998 | Lin et al. |
| 5,854,822 | A | | 12/1998 | Chornenky et al. |
| 5,984,853 | A | | 11/1999 | Smith |
| 6,148,061 | A | | 11/2000 | Shefer et al. |
| 6,195,411 | B1 | | 2/2001 | Dinsmore |
| 6,208,232 | B1 | | 3/2001 | Chen |
| 6,463,124 | B1 | * | 10/2002 | Weisman et al. |

OTHER PUBLICATIONS

Dinsmore, M., et al. "A new miniature x–ray source for interstitial radiosurgery: device description." Med. Phys. 23 (1), Jan. 1996. pp. 45–52.

* cited by examiner

*Primary Examiner*—Drew A. Dunn
*Assistant Examiner*—Hoon Song
(74) *Attorney, Agent, or Firm*—Nutter McClennen & Fish LLP; Thomas J. Engellenner; Reza Mollaaghababa

(57) ABSTRACT

The present invention provides a catheter having an x-ray generator unit at its tip which generates x-ray radiation having a wavelength in a range effective for treating biological tissue. In one embodiment, the x-ray generator unit includes a miniature x-ray generator and a miniature transformer that form, in combination, a monolithic device. The transformer includes a primary winding that receives an input voltage in a range of 100 V to 4 kV from a power source, via a flexible cable that runs from the proximal end of the catheter body to its distal end. The transformer further includes a secondary winding that up-converts the input voltage to generate an output voltage in a range of 10 kV to 40 kV to be applied to a cathode of the x-ray generator. The cathode emits electrons in response to the applied voltage, and an extraction electrode guides the emitted electrons to an anode, which is preferably formed of a high-Z refractory metal. The impact of the electrons with the anode effects generation of x-ray radiation, a portion of which is transmitted via an x-ray transmissive window to the outside environment. One significant advantage of the device of the invention is that by employing a lower voltage in the body of the catheter and confining a higher voltage to a short, rigid section at the distal end of the catheter, the device provides enhanced mechanical flexibility and lowers the likelihood of electrical breakdown.

33 Claims, 6 Drawing Sheets

CATHETER TIP X-RAY SOURCE

BACKGROUND OF THE INVENTION

The present invention relates generally to a catheter, and more particularly, to a catheter having a miniature x-ray generator unit at its tip for providing a biologically effective dose of x-ray radiation.

X-ray radiation having a biologically effective spectrum, for example, having an energy in a range of about 10 keV to about 40 keV, can be utilized for a variety of medical treatments. For example, such x-ray radiation can be employed for preventing restenosis in blood vessels that have undergone angioplasty and/or it can be employed in some oncological procedures, such as interstitial radiosurgery of tumors.

Miniature x-ray generators that produce biologically effective radiation, and that can be deployed in proximity of a target tissue by utilizing flexible catheters, are known. Such x-ray generators provide advantages over radioactive isotopes, such as, $^{90}$Sr, $^{32}$P, or $^{192}$Ir, as sources of x-ray radiation. For example, unlike the radioactive isotopes, the energy spectrum and/or the dose rate provided by these x-ray generators can be varied over a relatively wide range.

A conventional approach to powering a miniature x-ray generator disposed in a catheter utilizes an external power supply to generate a high voltage, e.g., in a range of about 10 to 40 kV, required by the x-ray generator, and transmits the voltage to the generator via a small-diameter electrical cable that extends from the power supply through the catheter to the generator.

This approach has a number of disadvantages. For example, the thickness of an insulation layer needed to insulate the electrical cable can adversely affect the flexibility of the cable, and consequently maneuverability of the catheter. Further, there is a danger of insulation breakdown, particularly, during a medical procedure. Such insulation failure can at the least require the withdrawal of the catheter and the x-ray tube, or more ominously, it can expose the patient or medical personnel to electrical shock.

Accordingly, there is a need for a catheter having an x-ray generator which provides enhanced operational safety, ease of construction, and better flexibility.

SUMMARY OF THE INVENTION

The present invention provides a catheter having a flexible body that extends from its proximal end to its distal end. The catheter further includes an x-ray generator disposed in the distal end region of the flexible body for generating biologically effective x-ray radiation, for example, x-ray radiation having an intensity in a wavelength range that is effective for treating a patient's tissue. A miniature transformer is also disposed in the distal end region of the flexible body, and is electrically coupled to the x-ray generator, to power the generator. More particularly, the transformer includes a primary winding that receives an AC input voltage having a root-mean-square (rms) amplitude, for example, in a range of about 100 V to about 4 kV, and further includes a secondary winding that applies an AC output voltage having an rms amplitude, for example, in a range of about 10 kV to about 40 kV, to the x-ray generator. The incorporation of the miniature transformer at the distal end of the catheter eliminates the need for a high voltage transmission line along the entire length of the instrument and greatly reduces the insulation needed within the body of the catheter.

In one aspect, the x-ray generator has a length that is less than about 30 millimeters, and a maximum cross-sectional dimension, for example, a diameter when the cross-section is circular, that is equal or less than approximately 3 millimeters. Further, the transformer can have a length that is less than about 50 millimeters and a maximum cross-sectional dimension that is equal or less than approximately 3 millimeters. The small dimensions of the x-ray generator and the transformer advantageously allow their coupling to the tip of a catheter having an outer diameter with a dimension of a few millimeters to be deployed, for example, in a patient's artery to irradiate a selected tissue target.

The x-ray generator and the transformer can be formed as a monolithic device. Alternatively, the x-ray generator and the transformer can be formed as separate devices that are mechanically and electrically coupled to one another.

In further aspects, a catheter of the invention includes a flexible electrical cable, having a diameter in a range of about one millimeter to about two millimeters, that extends from the proximal end to the distal end of the catheter body. The electrical cable transmits an AC input voltage from an AC source, for example, an AC power converter, to the primary winding of the transformer. The electrical cable can be, for example, in the form of a coaxial cable having a pair of elongated coaxial conductors, one of which is electrically grounded and the other carries an AC electrical voltage to the primary winding of the transformer. An insulating inner layer having a thickness in a range of about 0.01 mm to about 0.2 mm insulates the two conductors from one another. In addition, an outer insulating layer having a thickness in a range of about 0.001 mm to about 0.2 mm provides an insulating cover for the cable. The insulting layers can be formed of a variety of materials, such as, polyethylene or Teflon™. The inner insulating layer is preferably selected to be able to withstand a voltage differential in a range of about 100 V to about 4 kV.

In another aspect, the x-ray generator can generate radiation having an energy in a range of about 10 keV to about 40 keV, and provides an x-ray output power in a range of about 1 mW to about 100 mW. The x-ray generator can include an evacuated housing and a cathode that is disposed in that housing. The cathode is preferably formed of a metal, such as tungsten, and is electrically coupled to the secondary winding of the transformer to receive a voltage in a range of about 10 kV to about 40 kV therefrom. Other methods, such as, carbon nanotube or micro-machined silicon pyramid, can also be utilized for forming the cathode. The x-ray generator can further include an anode separated from the cathode by a selected distance. The anode is preferably formed of a high-Z refractory metal, such as tungsten, and can be electrically grounded so as to create an electrical potential difference between the cathode and the anode, thereby generating an electric field therebetween. The cathode emits electrons in response to application of a voltage thereto, for example, during a negative portion of each cycle of an AC voltage. The electric field between the cathode and the anode accelerates these electrons to the anode, and the impact of the electrons with the anode effects production of x-ray radiation.

In further aspects, the x-ray generator can include a window that is substantially transparent to the x-ray radiation to facilitate transmission of the generated radiation to the outside environment. The window has preferably a transmission coefficient of approximately 99% or higher for x-ray radiation having an energy in a range of about 10 keV to about 40 keV. In one embodiment, the window is formed of beryllium and has a thickness in a range of approximately 10 microns to approximately 100 microns. The window can be formed of a sheet of a material having a substantially uniform thickness, and can be directly coupled to the housing of the x-ray generator, for example, in an opening provided in the housing. Alternatively, the window can be supported by a mesh, which is in turn mechanically coupled to the x-ray generator's housing.

In a related aspect, the x-ray generator can include an extraction electrode disposed in the housing between the cathode and the anode, and maintained at an electrical potential intermediate the potential difference between the cathode and the anode. The extraction electrode can advantageously control emission of electrons from the cathode, and can further focus the emitted electrons onto the anode.

In other aspects, the transformer can include a core that has preferably a cylindrical shape, and is formed of a ferromagnetic material, such as iron or a ferrite composed of oxides of Fe, Ni, Mn, and Zn. The cylindrical core can have a diameter, for example, in a range of about 0.1 mm to about 2 mm, and a length in a range of about 5 mm to about 30 mm. Further, the primary and the secondary windings of the transformer can be formed of coils, constructed of a conductive metal, such as copper wire. The low current, e.g., in a range of about 10 to 100 microamperes, flowing through the secondary windings, and proportionally higher through the primary winding, while the transformer is operational allows utilizing small-diameter wire for the construction of the windings. For example, in one embodiment, copper wire having a diameter in a range of approximately 0.025 mm to approximately 0.1 mm is employed for constructing the secondary winding, and copper wire having a diameter in a range of approximately 0.1 mm to 0.6 mm is employed for constructing the primary winding. Those skilled in the art will appreciate that conductive wires formed of other materials and/or having other diameters or shapes other than circular (e.g., oval or rectangular) can also be utilized for forming the transformer windings so long as the electrical resistance of the wiring is sufficiently low to allow the passage of the requisite currents through the windings without a high degree of heat generation and/or unduly increasing the size of the transformer.

In a related aspect, the transformer can include two secondary windings, one of which applies an AC voltage to the cathode of the x-ray generator, and the other applies an AC voltage to the extraction electrode. Alternatively, the transformer includes one secondary winding having a primary tap for applying a voltage to the cathode, and a secondary tap for applying a voltage to the extraction electrode.

In another aspect, the core, the primary and the secondary windings of the transformer can be "potted" in an insulating material, such as, polyethylene, silicone, epoxy, or polyurethane that electrically insulates these transformer components from the housing. The insulation layer covering these transformer components can preferably withstand voltage differences of approximately 40 kV or higher.

In another aspect, a catheter of the invention includes a miniature x-ray generator having a plurality of cathodes and anodes. The multiple cathodes and anodes can be utilized, for example, to ensure that at least one cathode emits electrons during each of the negative and positive swings of the AC voltage of the secondary winding of the transformer, thereby enhancing the efficiency of x-ray generation.

Exemplary embodiments of the invention will be described below with reference to the following drawings to provide further understanding of the invention.

DETAILED DESCRIPTION

The present invention provides a flexible catheter having at its tip a miniature transformer coupled to an x-ray generator for powering the x-ray generator. The x-ray generator and the transformer can be formed as a monolithic device, or alternatively, they can be formed as separate devices that are mechanically and electrically coupled to one another. The x-ray generator produces x-ray radiation in a biologically effective wavelength range, for example, in a range of about 10 keV to about 40 keV. Further, the transformer includes a primary winding that receives an input AC voltage having a root-mean-square amplitude in a range of about 100 V to 4 kV, and a secondary winding that up-converts the input voltage to generate an output voltage having an rms amplitude in a range of about 10 kV to about 40 kV for powering the x-ray generator. The use of the transformer in proximity of the x-ray generator, and more preferably, as a portion of a monolithic x-ray generation unit formed of the transformer and the x-ray generator, advantageously allows a more flexible electrical cable to be utilized for transmission of an input voltage across the catheter, and also allows a safer operation of the catheter, as described in more detail below.

Figure 1:
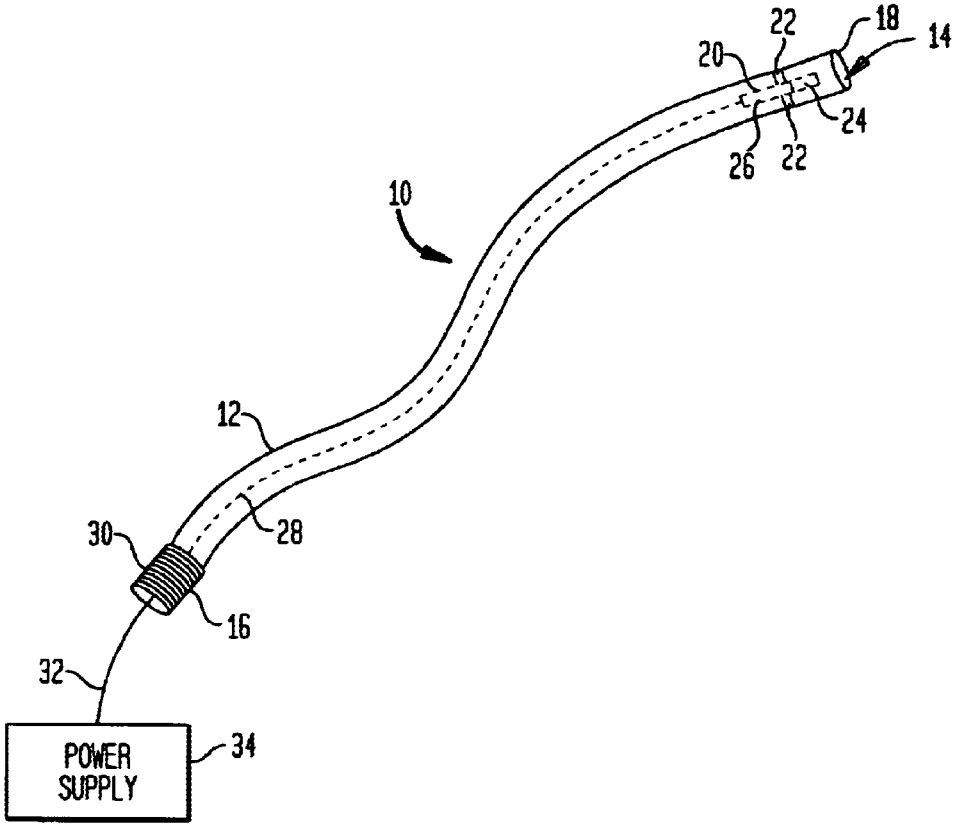
FIG. 1 is a perspective view of a catheter according to an exemplary embodiment of the invention having an x-ray generation unit at its tip which includes a miniature x-ray generator that is powered by a miniature transformer.

With reference to FIG. 1, an exemplary catheter 10 according to the present invention includes a flexible body 12 having a lumen 14 that extends from a proximal end 16 of the flexible body to a distal end 18 thereof. The flexible body has an outer diameter in range of about 1 to about 4 millimeters, and is sufficiently flexible to be readily guided through a patient's lumen, e.g., a patient's artery, to be deployed in proximity of a target region that needs to be treated with x-ray radiation. A variety of materials can be employed for manufacturing the flexible body 12. These materials can include, but are not limited to, polyethylene and Teflon™.

An x-ray generator unit 20 is coupled to the catheter's body in a distal end region thereof, and more preferably, at the tip of the catheter by one or more support elements 22. The exemplary x-ray generator unit 20 includes an x-ray generator 24, and a transformer 26 that provides power for the x-ray generator 24. In this embodiment, the x-ray generator 24 and the transformer 26 are formed as a monolithic device, as discussed in detail below. In other embodiments, the x-ray generator 24 and the transformer 26 can be formed separately and be mechanically and electrically coupled to one another.

Figure 2:
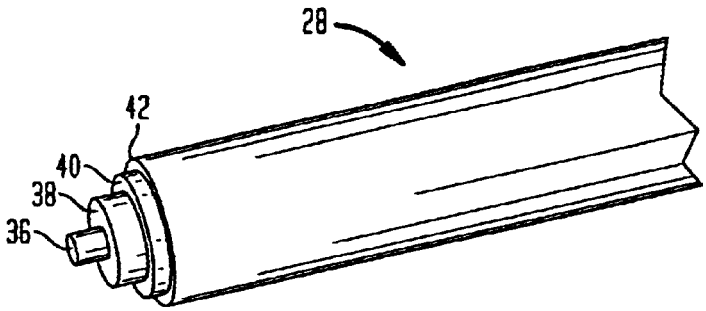
FIG. 2 is a partial perspective view of a coaxial cable that can be utilized for transmitting an input AC voltage from a power supply to a primary winding of the miniature transformer of the x-ray generation unit of the previous figure, FIG. 3 schematically illustrates a miniature transformer coupled to a miniature x-ray generator to form the x-ray generation unit of FIG. 1 as a monolithic device.

A flexible electrical cable 28 extends from the proximal end 16 of the catheter body 12 to its distal end 18, and is electrically coupled to the transformer 26. The electrical cable 28 can be, for example, a flexible coaxial cable that is connected at one end, via a connector 30 and a cable 32, to a power supply 34. As shown in FIG. 2, the coaxial cable 28 can include an inner conductor 36, and an inner insulation layer 38 having a thickness in a range of about 0.01 mm to 0.2 mm that covers the inner conductor 36. The exemplary coaxial cable 28 further includes an outer conductor 40, for example, in the form of braided copper wiring, that is covered by an outer insulation layer 42 having a thickness in a range of about 0.001 mm to about 0.2 mm. In operation, the outer conductor 40 is grounded, and the inner conductor 36 is coupled to a primary winding of the transformer 26, as described in more detail below, to transmit an input AC voltage from the power supply 34 to the primary winding. The input AC voltage can have a root means square (rms) amplitude in a range of about 100 V to about 4 kV, and a frequency in a range of about 60 Hz to about 10 MHz.

Although in this embodiment, the catheter 10 includes a lumen, in another embodiment, the flexible body of the catheter can be constructed without a lumen, and the x-ray generator unit 20 still be coupled to the distal region of the catheter. Alternatively, the flexible body of such a catheter can include a housing in its distal region for accommodating the x-ray generator unit 20. Further, the flexible body of such a catheter can include a channel extending from its proximal end to its distal end in which the flexible cable 28 can be disposed. Alternatively, the flexible cable can be disposed on the external wall of the flexible body of the catheter. Those skilled in the art will appreciate that structures for the flexible body other than those described above, and other modes of coupling the generator unit and the flexible cable to the flexible body of the catheter, can also be utilized.

Figure 3:
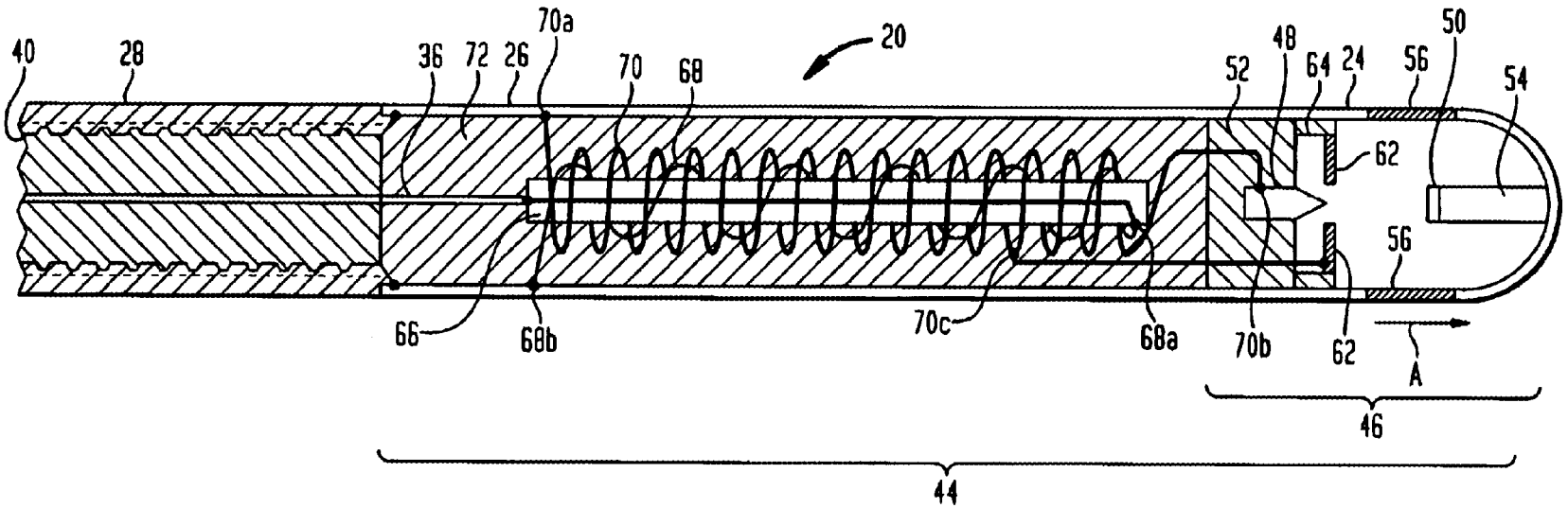

With reference to FIG. 3, the x-ray generating unit 20 includes a housing 44 in which the miniature transformer 26 and the miniature x-ray generator 24 are disposed. The exemplary housing 44 has a circular cross-section, although other cross-sectional shapes can also be utilized, with a diameter that is preferably less than about 4 millimeters, for example, in range of about 1 to about 3 millimeters, and a length that is in a range of about 20 to 50 millimeters. A portion 46 of the housing 44 is evacuated for accommodating various components of the x-ray generator 24. The housing 44 is preferably formed of a metal, such as, stainless steel, and can be electrically grounded via electrical and mechanical coupling to the outer conductor 40 of the flexible cable 28 (or a third ground wire).

The exemplary x-ray generator 24 includes a cathode 48 separated from an anode 50 along an axial direction A of the housing 44. In this embodiment, the cathode 48 is a field emitter cathode, formed for example of tungsten, that emits electrons during a negative portion of each cycle of an AC voltage applied thereto by a secondary winding of the transformer 26, as described in more detail below. A support element 52, in the form of an annular ring that is mechanically coupled to the housing 44, can be used to position the cathode 48 centrally within the housing 44, and provide a vacuum-tight coupling with the cathode 48 to ensure that the portion 46 of the housing 44 is maintained at a sufficiently low pressure, e.g., a pressure in a range of about $10^{-7}$ torr to about $10^{-5}$ torr, to allow operation of the x-ray generator 24.

The miniature x-ray generator 24 can further include a heat sink 54, for example, in the form of a solid cylinder formed of a metal, such as copper, that is coupled mechanically and electrically at one end to the housing 44, and at its other end to the anode 50. The heat sink 54 can be connected to the housing and/or the anode by utilizing any suitable technique. For example, the heat sink 54 can be soldered or braised to the housing and/or the anode. Alternatively, the heat sink and the housing can be machined as a monolithic structure. The heat sink 54 mechanically supports the anode 50 within the housing 44, and removes heat from the anode 50 during the operation of the x-ray generator 24. Further, the heat sink 54 maintains the anode 50 at the ground electrical potential via its coupling to the housing 44, which, as described above, can be maintained at the ground electrical potential. It is well known that metals with high atomic numbers, so-called high Z metals, are particularly suitable for efficient production of x-ray radiation. Accordingly, the anode 50 is preferably formed of a high-Z refractory metal, such as tungsten.

Figure 4A:
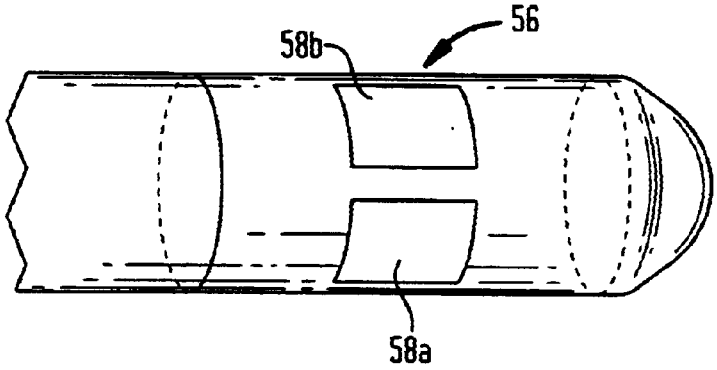
FIG. 4A is a partial perspective view of a catheter according to the teachings of the invention illustrating two of a plurality of beryllium window sections that form an x-ray transmissive window for coupling the generated x-ray radiation to the outside environment.
Figure 4B:
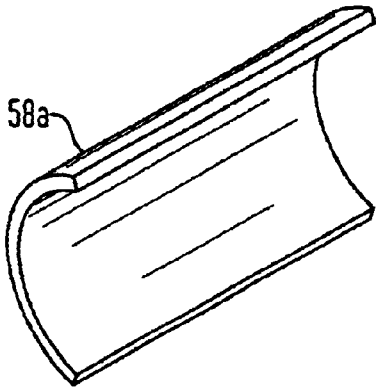
FIG. 4B is a perspective view of one of the window sections depicted in the previous figure which has a curved structure with a radius of curvature commensurate to that of the housing, FIG. 4C schematically depicts a mesh that can be utilized in some embodiments for providing support for any one of the window sections depicted in FIG. 4A.

With continuing reference to FIG. 3, the exemplary miniature x-ray generator 24 further includes an x-ray transmissive window 56 that allows transmission of the generated x-ray radiation to the outside environment. The window 56 has preferably a transmission coefficient of approximately 99% or higher for x-ray radiation having an energy in a range of about 10 keV to about 40 keV. With reference to FIG. 4A, in this exemplary embodiment, the window 56 can be formed of a plurality of beryllium window sections, such as sections 58*a*, 58*b*, herein collectively referred to as window sections 58, disposed in the metal housing 44, and spanning a circumference of a portion of the cylindrical housing to provide an approximately 360 degree field of view, or a smaller fraction thereof, depending on the application of the x-ray radiation, for transmission of the generated x-rays to the outside environment. Each beryllium window section 58 can be formed, for example, as a curved structure, such as that shown in FIG. 4B, having the same radius of curvature as that of the cylindrical housing and a thickness in a range of about 10 to about 100 microns.

Figure 4C:
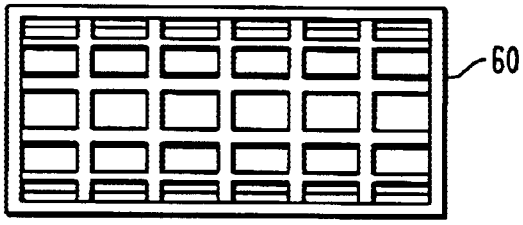
FIG. 4D is an end sectional view of the mesh of FIG. 4C.
Figure 4D:
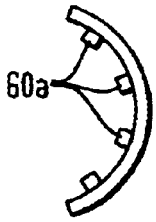

With reference to FIGS. 4C and 4D, in some embodiments, each beryllium window section 58 can be supported by a mesh 60, herein referred to as "waffle" support formed, for example, of a metal such as stainless steel. The mesh 60 can be mechanically coupled to the housing 44, and can include protrusions 60*a* in the form of metal "ribs" for contact with the beryllium window section that it supports.

Those having ordinary skill in the art will appreciate that materials, such as, diamond-like carbon or diamond, can also be employed to construct x-ray transmissive windows for use in a catheter of the invention.

Referring again to FIG. 3, the x-ray generator 24 can optionally include an extraction electrode 62 coupled to the housing 44 via a support element 64 to be positioned in proximity of the cathode 48. The support element 64 can be, for example, an annular ring, formed of an insulating material, which is coupled to the inner surface of the housing 44. The support elements 52 and 64 can be formed as a monolithic unit, as shown in this embodiment, or alternatively as separate structures. The extraction electrode 62 is maintained at an electric potential that is intermediate that of the cathode 48 and the anode 50, as described in detail below, to control electron emission from the cathode 48, and to focus the electrons emitted from the cathode onto the anode.

With continuing reference to FIG. 3, the exemplary miniature transformer 26 includes a core 66, which is preferably formed of a ferromagnetic material, such as iron or a ferrite composed of oxides of Fe, Ni, Mn and Zn. The exemplary core 66 is in the form of an elongate cylinder having a diameter in a range of about 0.1 millimeters to about 2 millimeters, and a length in a range of about 5 millimeters to about 30 millimeters. The core 66 can be electrically isolated or can be connected electrically to the inner conductor 36 of the coaxial cable 28, whose outer conductor 40 is electrically coupled to the metal housing 44 in order to maintain the housing at a ground electrical potential.

The transformer 26 further includes a primary winding 68 in the form of a coil having a number of turns in a range of about 5 to about 60 turns that are wound on the ferrite core 66. The primary winding 68 is connected electrically at one end 68*a* to the inner (non-grounded) conductor of the input power cable, and at its other end 68*b* to the housing 44. Thus, a voltage differential between the inner and the outer conductors (36, 40) of the cable 28 is applied across the primary winding to induce a current therein, and consequently a magnetic flux within the core 66, as discussed in more detail below. The primary winding coil can be formed, for example, of copper wire having a diameter in a range of approximately 0.16 millimeters (#34 gauge wire) to approximately 0.57 millimeters (#23 gauge). Alternatively, a ribbon can be utilized to form the primary winding 68. A coil forming the primary winding is preferably wound tightly around the ferrite core 66 so as to produce negligible effect on the overall diameter of the transformer.

The transformer 26 further includes a secondary winding 70 in the form of a coil having a number of turns in a range about 100 to about 1000 turns that are wound on the ferrite core 66. The coil 70 can be formed, for example, of copper wire having a diameter of approximately 0.080 millimeters and a resistance of about 3.85 ohm/meter, e.g., #40 gauge copper wire.

The secondary winding 70 is coupled at one end 70*a* to the housing 44, and is coupled, mechanically and electrically, at its other end 70*b*, herein referred to as primary tap, to the cathode 48 to apply a voltage in a range of about 10 kV to about 40 kV thereto. The secondary winding 70 is connected electrically at a secondary tap 70*c* to the extraction electrode 62 in order to apply a voltage, which is less than the voltage applied to the cathode 48, thereto.

The exemplary ferrite core 66, and the primary and secondary windings 68 and 70 can be "potted" in an insulator 72, such as, silicone, epoxy, polyethylene, polyimide or Teflon™, that electrically insulates these components from the housing 44. The insulator 72 is preferably selected so as to withstand an electrical potential difference of at least 40 kV.

The primary and the secondary windings of the exemplary transformer 26 exhibit an inductance to resistance ratio (L/R) that is significantly higher than the inverse of the voltage frequency. For example, at a frequency (f) of 1 MHz, the inductance to resistance ratio of the secondary winding 70 having 600 turns (and a diameter of 2.1 mm including insulation for 40 kV potential difference, wound on a ferrite core having a magnetic permeability of 100) is approximately $3\times10^{-4}$ s, which is approximately three orders of magnitude greater than $(2\pi f)^{-1}=1.6\times10^{-7}$ s.

Figure 5A:
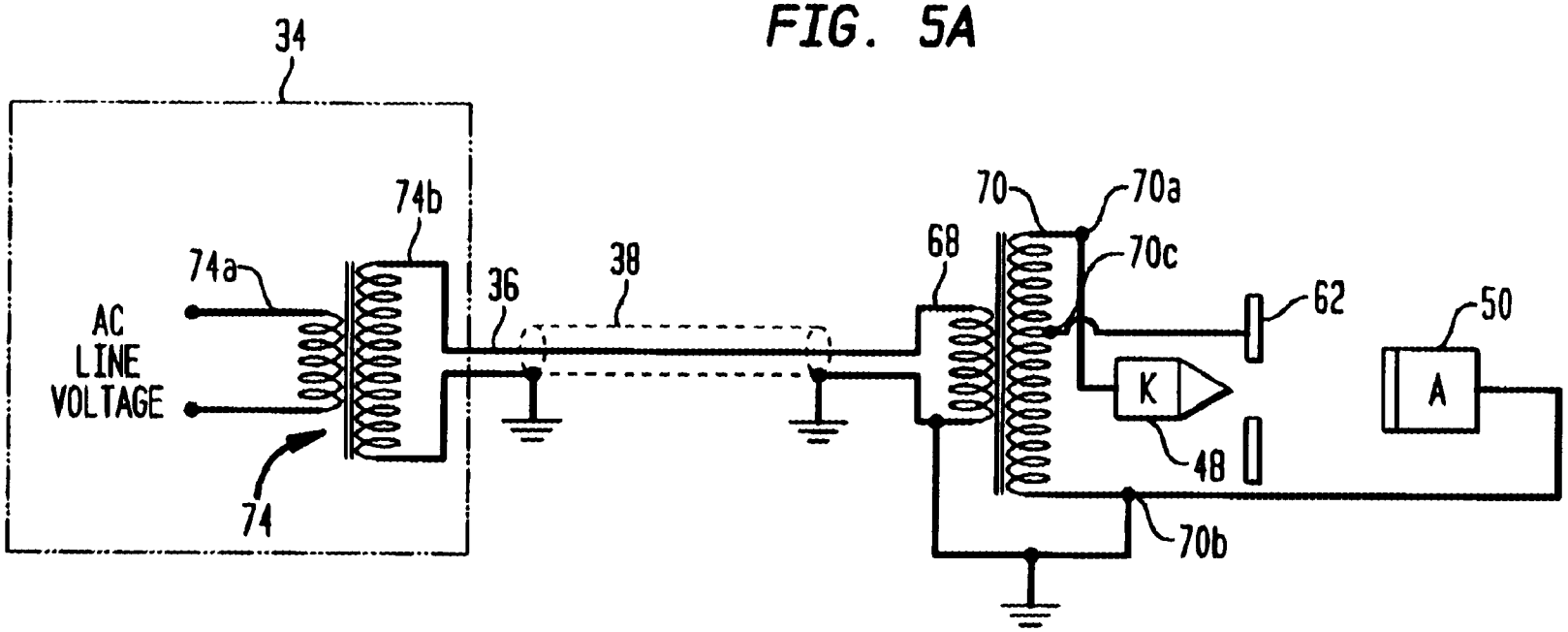
FIG. 5A is a diagram illustrating electrical interconnections of various components of the x-ray generation unit of FIG. 1.

With reference to FIG. 5A, in operation, the primary winding 68 of the transformer 26 (FIG. 3) receives an input AC voltage from the power supply 34 (FIG. 1), via the inner conductor 36 of the electrical cable 28 (FIG. 3). The power supply 34 can have a transformer 74 that receives the AC voltage at a primary winding 74*a*, and generates an output voltage having an rms amplitude in a range of about 100 V to about 4 kV at a secondary winding 74*b*. This output voltage is applied, via the inner conductor 36 of the cable 38, to the primary winding 68 of the miniature transformer 26, and generates an AC current in a range of about 200 microamperes to about 5 milliamperes therein. The AC current through the primary winding 68 in turn generates a time-varying magnetic flux in the core 66 (FIG. 3), and consequently in the secondary winding 70.

This time-varying magnetic flux induces a voltage across the secondary winding 70. Because the number of turns of the coil forming the secondary winding is approximately 40 to 100 times higher than that of the primary winding, the voltage induced in the secondary winding has an rms value in a range of about 10 to 40 kV, and more preferably, in a range of about 20 to about 30 kV (rms). The induced voltage at the primary tap 70*a*, which equals the voltage generated across the entire secondary winding 70, is applied to the cathode 48, thereby generating a time-varying electric field between the cathode 48 and the anode 50, which is maintained at a ground electric potential. The AC voltage applied to the cathode further causes emission of electrons therefrom during each negative swing of the voltage. Further, the voltage induced at the secondary tap 70*c*, which equals a selected fraction of the voltage induced across the entire secondary winding, is applied to the extraction electrode 62.

The electric field established between the cathode 48 and the anode 50 accelerates these electrons to energies in a range of about 10 keV to about 40 keV upon impact with the anode. The impact of the electrons with the anode causes generation of x-ray radiation. As discussed above, the anode is preferably formed of a high-Z metal to enhance the x-ray production. Electrons with an energy of about 30 keV typically convert between about 0.05% to 0.25% of their kinetic energy into x-ray energy when they impinge on a high-Z metal, such as tungsten. A portion of the x-ray radiation that escapes to the outside environment through the window 56 can be utilized for a variety of different applications, as discussed in more detail below.

Figure 5B:
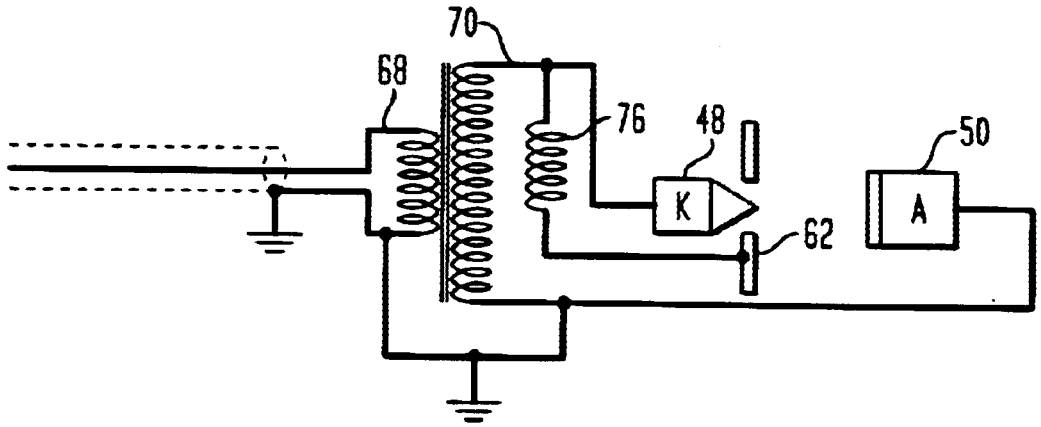
FIG. 5B is another diagram illustrating electrical interconnections of another embodiment of an x-ray generator unit according to the teachings of the invention having two secondary windings, one of which applies a voltage to the cathode and the other applies a voltage to an extraction electrode of the x-ray generator, FIG. 6 schematically illustrates an x-ray generator for use in a catheter of the invention having two cathodes and two anodes.

With reference to FIG. 5B, in another embodiment, the exemplary transformer 26 also includes another secondary winding 76 that is formed of a coil having approximately 20 to 200 turns, and is wound on the ferrite core 66 shown in FIG. 3. This secondary winding 76 is mechanically and electrically coupled at one end to the extraction electrode 62 to apply a voltage thereto, which is intermediate the voltage difference between the cathode and the anode.

Further, the time-varying magnetic flux generated by the current in the primary winding 68 induces a voltage in the second secondary winding 76, which is applied to the extraction electrode 62. Because the number of turns of the coil forming the winding 76 is less than that of the winding 70, e.g., 120 turns compared to 600 turns, the voltage induced across the winding 76 is less than that induced in the winding 70, e.g., in range of about 2 to 8 kV. The application of this intermediary voltage to the extraction electrode helps guide the electrons emitted from the cathode 48 to the anode 50.

An x-ray generator unit in accordance with the teachings of the invention, such as the exemplary unit 20 described above, provides a number of distinct advantages. For example, it is sufficiently small to be coupled to the tip of a catheter having an outer diameter of a few millimeters, thereby permitting its use, for example, within a patient's artery. Further, the close proximity of the step-up transformer to the x-ray generator obviates the need for transmission of high voltages, e.g., in the range of 10 to 40 kV, from an external power supply, along an electrical cable that extends from the proximal end to the distal end of the catheter, to the x-ray generator. Rather, the electrical cable in a catheter of the invention carries much lower voltages, e.g., in a range of about 100 V to about 4 kV. This allows the use of a more flexible cable in a catheter of the invention, and further enhances operational safety of the catheter. The term "proximity" as used herein to describe the spatial relationship of the transformer and x-ray generator is extended to describe separation distances less than about 50 millimeters, typically on the order of a few millimeters or less.

Thus, in a catheter of the invention, high electrical voltages are confined to the step-up transformer and its associated x-ray generator. This advantageously enhances the operational safety of the catheter, especially in medical applications in which the catheter is inserted in a patient's lumen. Further, the lowering of the voltage transmitted by the flexible cable allows utilizing a thinner insulation layer for the cable, thereby resulting in a more flexible cable that enhances the overall flexibility of the catheter. In addition, in a catheter of the invention, the transformer can be advantageously powered by a low-cost AC frequency converter. Hence, a catheter of the invention not only exhibits enhanced safety and flexibility but it can also be constructed in a cost efficient manner. In fact, a catheter of the invention can be constructed as a single-use item.

A catheter of the invention can be utilized in a number of different applications. In one such application, it is employed in medical procedures to deliver highly localized, biologically effective doses of ionizing radiation to a patient's tissue. For example, a catheter of the invention can be utilized to deliver an x-ray dose in a range of about 8 Gray to about 20 Gray (800 to 2000 rads) to a localized portion of a patient's tissue. The x-ray radiation can be effective, for example, in preventing restenosis. In addition, the x-ray radiation can be employed for interstitial radiosurgery of tumors. It is clear to those skilled in the art that the catheter of the invention can find numerous other medical applications.

Figure 6:
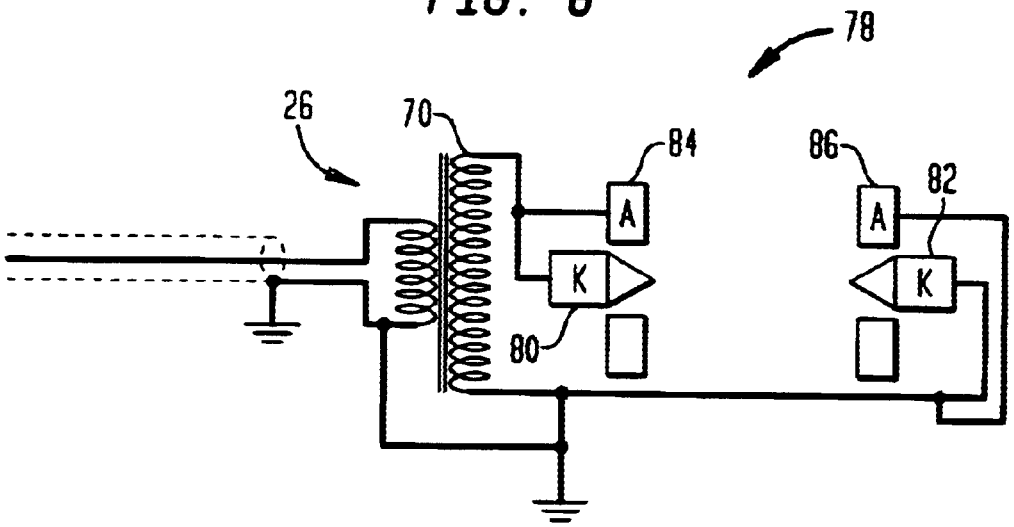

Although in the embodiments described above, the x-ray generator 24 includes one cathode and one anode, in other embodiments of the invention, the x-ray generator can include a plurality of cathodes and anodes to more efficiently utilize an AC voltage for generating x-ray radiation. For example, FIG. 6 depicts an x-ray generator 78 according to the invention that includes two cathodes 80 and 82, which can be field emission cathodes formed of tungsten, and two anodes 84 and 86 each of which is in the form of an annular ring formed, for example, of tungsten. The cathode 80 and the anode 84 are coupled to the secondary winding 70 of the transformer 26 such that the positive and negative swings of the voltage across the secondary winding 70 are applied to the cathode 80 and the anode 84. In contrast, the cathode 82 and the anode 86 are grounded. During a negative swing of the voltage across the secondary winding 70, the cathode 80 emits electrons that are accelerated to the anode 86 to impact that anode, thereby generating x-ray radiation. Further, during a positive swing of the voltage induced across the secondary winding 70, the cathode 82 emits electrons which are accelerated towards the anode 84, which during a positive voltage swing is at a higher electrical potential, and cause generation of x-ray radiation upon impact with that anode. Hence, in this manner, x-ray radiation is generated during the entire period of each cycle of an AC voltage induced in the secondary winding of the transformer 26, rather than during only one-half of each cycle.

Figure 7:
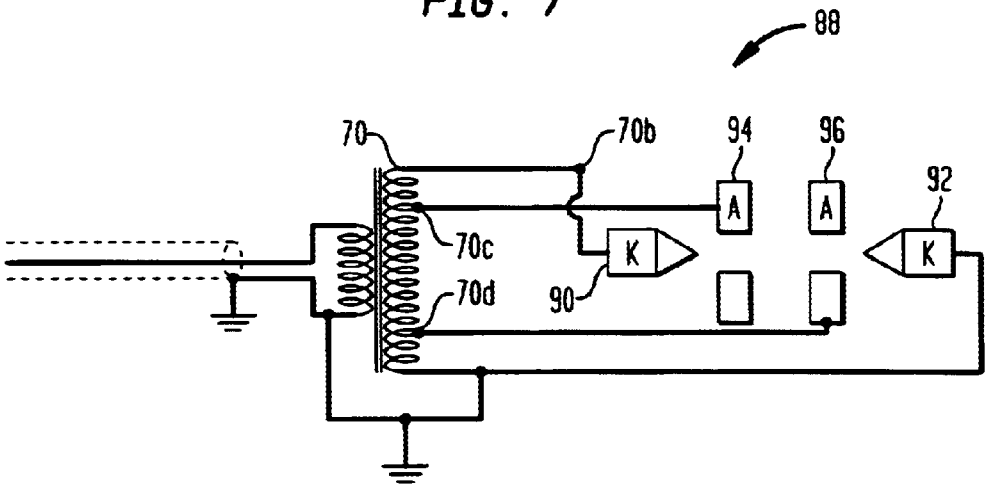
FIG. 7 is a schematic diagram of another x-ray generator with multiple cathodes and anodes that is suitable for use in a catheter of the invention.

Miniature x-ray generators, having multiple cathodes and anodes, which can be utilized in a catheter of the invention as x-ray sources are not limited to the x-ray generator 78, described above. For example, FIG. 7 depicts another x-ray generator 88 according to the teachings of the invention which also includes two cathodes 90 and 92 and two anodes 94 and 96. In contrast to the x-ray generator 78, the cathode 90 and the anode 94, and similary, the cathode 92 and the anode 96, are not held at the same electrical potential. Rather, while the cathode 90 is connected across the entire secondary winding at a primary tap 70*b*, the anode 94 is connected across a portion of the secondary winding at a secondary tap 70*c*. Further, while the cathode 92 is grounded, the anode 96 is connected across a portion of the secondary winding of the transformer at a tertiary tap 70*d*. This arrangement allows the anodes 94 and 96 to function not only as anodes but also as extraction electrodes in alternative positive and negative voltage swings of the voltage induced across the secondary winding 70.

The embodiments of the invention described above are intended to be interpreted as illustrative and not in a limiting sense. Those skilled in the art shall be able to make numerous variations and modifications to the above embodiments without departing from the scope of the invention. For example, materials other than those described above can be utilized to form the cathode and the anode of the x-ray generator. In addition, those skilled in the art can readily utilize the teachings of the invention for constructing a miniature x-ray generator that includes more than two cathodes and two anodes.

What is claimed is:

1. A catheter, comprising:

a flexible body extending from a proximal end to a distal end thereof, an x-ray generator disposed in the distal end region of the flexible body for generating radiation in a biologically effective wavelength range, and a transformer also disposed in the distal end region in proximity of the x-ray generator and electrically coupled thereto, the transformer having a primary winding for receiving an AC input voltage and a secondary winding for generating an AC output voltage for powering the x-ray source.

2. The catheter of claim 1, wherein the primary winding receives an AC input voltage having a root mean square (rms) amplitude in a range of about 100 V to about 4 kV, and the secondary winding generates an AC output voltage having a root mean square (rms) amplitude in a range of about 10 to about 40 kV.

3. The catheter of claim 2, wherein the primary winding receives an AC input voltage having a frequency in a range of about 60 Hz to about 10 MHz.

4. The catheter of claim 1, wherein the x-ray generator has a length less than about 30 millimeters.

5. The catheter of claim 4, wherein the x-ray generator has a maximum cross-sectional dimension equal or less than approximately 3 millimeters.

6. The catheter of claim 1, wherein the transformer has a length less than about 50 millimeters.

7. The catheter of claim 6, wherein the transformer has a maximum cross-sectional dimension equal or less than approximately 3 millimeters.

8. The catheter of claim 1, wherein the transformer and the x-ray generator form a monolithic device.

9. The catheter of claim 1, wherein the x-ray generator produces radiation having an energy in a range of about 10 keV to about 40 keV.

10. The catheter of claim 1, further comprising a flexible electrical cable having a diameter in a range of about 1 mm to about 3 mm extending from the proximal end to the distal end for transmitting an AC input voltage from an AC source to the primary winding of the transformer.

11. The catheter of claim 10, wherein the electrical cable comprises a pair of elongate coaxial conductors and an inner insulating layer having a thickness in a range of about 0.01 mm to about 0.2 mm which insulates the coaxial conductors from one another.

12. The catheter of claim 9, wherein the inner insulating layer of the electrical cable can withstand a voltage differential in a range of about 100 V to about 4 kV.

13. The catheter of claim 11, wherein the electrical cable further comprises an outer insulating layer having a thickness in a range of about 0.001 mm to about 0.2 mm which covers the conductors.

14. The catheter of claim 11, wherein the insulating layer of the electrical cable is formed of any of polyethylene, Teflon, or polyimide.

15. The catheter of claim 1, wherein the transformer includes a primary to secondary ratio is in a range of approximately 1/10 to approximately 1/100.

16. The catheter of claim 1, wherein the x-ray generator generates x-ray output power in a range of about 1 mW to about 100 mW.

17. The catheter of claim 1, wherein the x-ray generator comprises an evacuated housing and one or more cathodes disposed in the housing, the cathode being electrically coupled to the secondary winding to generate electrons in response to a voltage applied thereto by the secondary winding.

18. The catheter of claim 17, wherein the cathode is formed of a refractory metal.

19. The catheter of claim 18, wherein the cathode emits electrons during each negative half-cycle of the AC voltage applied thereto.

20. The catheter of claim 17, wherein the x-ray source further comprises an anode disposed in said housing and separated axially from said cathode, the anode being maintained at an electrical potential difference relative to the cathode for generating an electric field for accelerating the electrons emitted by the cathode to the anode such that the impact of the electrons with anode generates x-ray radiation.

21. The catheter of claim 17, wherein the x-ray source further comprises a window disposed in the housing, the window being substantially transparent to x-ray radiation to facilitate transmission of the generated x-ray radiation to outside environment.

22. The catheter of claim 18, wherein the window has a transmission coefficient of approximately 99% for x-ray radiation having an energy in a range of about 10 keV to about 40 keV.

23. The catheter of claim 19, wherein the window of is formed of beryllium and has a thickness in a range of about 10 microns to about 100 microns.

24. The catheter of claim 1, further comprising an insulation casing in which the x-ray generator and the transformer are disposed, said insulation being capable of withstanding a voltage differential of at least approximately 40 kV.

25. The catheter of claim 21, further comprising a beam-forming electrode disposed between the cathode and the anode for focusing electrons emitted by the cathode onto the anode.

26. The catheter of claim 22, wherein the transformer further comprises any of a secondary tap or another secondary winding electrically coupled to the beam-forming electrode to apply an AC voltage thereto.

27. The catheter of claim 1, wherein the transformer comprises a cylindrical core having a diameter in a range of about 0.1 mm to about 2 mm, and a length in a range of about 5 mm to about 30 mm.

28. The catheter of claim 24, wherein the transformer core is formed of a ferromagnetic material.

29. The catheter of claim 20, wherein the secondary winding of the transformer comprises a coil having about 40 to about 1000 turns wound on the core.

30. The catheter of claim 26, wherein the secondary winding coil is formed of a copper wire having a diameter in a range of about 0.01 mm to about 0.1 millimeter.

31. The catheter of claim 25, wherein the primary winding of the transformer comprises a coil having about 5 to about 60 turns wound on the core.

32. A catheter, comprising:

a flexible body extending from a proximal end to a distal end thereof, an x-ray generator disposed in the distal end region of the flexible body for producing x-ray radiation in a wavelength range effective for treating tissue, the x-ray generator having a maximum cross-sectional dimension equal or less than approximately 3 millimeters, a transformer also disposed in the distal end region in proximity of the x-ray generator and electrically coupled thereto, the transformer having a maximum cross-sectional dimension equal or less than about 3 millimeter and having a primary winding for receiving an AC input voltage and a second winding for generating an AC output voltage for powering the x-ray source, and a flexible electrical cable having a diameter in a range of about 1 to about 2 mm extending from the proximal end to the distal end of the flexible body and electrically coupled to the primary winding for transmitting an AC voltage in a range of about 100 V to about 4 kV from an voltage generator to the primary winding.

33. A catheter, comprising:

a flexible body having a lumen extending from a proximal end to a distal end thereof, an x-ray generator disposed in the distal end region of the flexible body for generating radiation in a biologically effective wavelength range, the x-ray generator having at least two cathodes and two anodes, a transformer also disposed in the distal end region in proximity of the x-ray generator and electrically coupled thereto, the transformer having a primary winding for receiving an AC input voltage and one or more secondary windings for generating an AC output voltage for powering the x-ray source, wherein the cathodes and the anodes are mechanically and electrically coupled to one another and to the transformer such that one of the cathodes emits electrons during a first portion of each cycle of the AC output voltage to strike one of the anodes and the other cathode emits electrons during a second portion of the cycle to strike the other anode.

* * * * *